US006976407B1

(12) United States Patent
Desaulniers

(10) Patent No.: US 6,976,407 B1
(45) Date of Patent: Dec. 20, 2005

(54) BROKEN BULB REMOVER

(75) Inventor: Yvon J. Desaulniers, Wolcott, CT (US)

(73) Assignee: Alden Corporation, Wolcott, CT (US)

( * ) Notice: Subject to any disclaimer, the term of this patent is extended or adjusted under 35 U.S.C. 154(b) by 0 days.

(21) Appl. No.: 10/907,357

(22) Filed: Mar. 30, 2005

(51) Int. Cl.[7] ..... H01K 3/32
(52) U.S. Cl. ..... 81/53.11
(58) Field of Search ..... 81/53.1, 53.11, 81/53.12, 52, 436

(56) References Cited

U.S. PATENT DOCUMENTS 2,117,017 A 5/1938 Chadsey
4,852,925 A * 8/1989 Lodin ..... 294/2
5,490,438 A 2/1996 Zupo et al.
6,584,662 B1 * 7/2003 Krick ..... 29/263
6,904,830 B1 * 6/2005 Desaulniers ..... 81/53.11

* cited by examiner

*Primary Examiner*—Jacob K. Ackun, Jr.
(74) *Attorney, Agent, or Firm*—McCormick, Paulding & Huber LLP

(57) ABSTRACT

A broken bulb remover with no moving parts comprising a rod serving as a handle with a central chamber open from the end of the rod to enclose the stem of a broken bulb. A lateral slot bifurcates part of the chamber for receiving the paddle-shaped part of the stem, which is used to unscrew the broken bulb. A tapered surface on the end of the rod contacts the inside wall of the broken glass envelope and stabilizes and centers the rod while it is rotated.

8 Claims, 2 Drawing Sheets

BROKEN BULB REMOVER

BACKGROUND OF THE INVENTION

Figure 1:
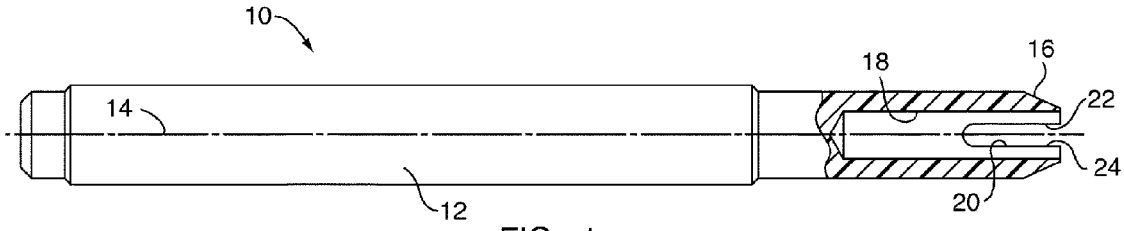

This invention relates to a tool or accessory for removing broken bulbs from electrical light fixtures. More particularly, the invention relates to removal of small broken bulbs such as those found in strings of Christmas tree lights.

A well-known problem arises when an electric light bulb is inadvertently broken while it is still in the socket. In addition to the possible electrical hazards, the glass envelope that encloses the filament and glass stem encasing the filament is completely shattered, leaving dangerous and sharp remnants of the glass envelope protruding from the light socket. Oftentimes, the threaded metal shell in the base of the light bulb is tightly engaged with the threaded wall of the socket. There is nothing to grasp and turn to remove the broken light bulb from the socket. It may be difficult also to electrically isolate and inactivate the wiring leading to the socket, leaving an electrical hazard in addition to a physical hazard.

The problem is more acute when removing small broken bulbs, because there is less surface to grasp and a smaller lever arm, due to the smaller diameter of the bulb.

An improved broken bulb remover is disclosed in my U.S. patent application Ser. No. 10/778,294 filed Feb. 13, 2005 and assigned to the present assignee. In that application, a broken bulb remover was disclosed having two longitudinal members connected to pivot about a fulcrum point and having ribs for engagement with the stem of the broken bulb. While my two piece pivoting broken bulb remover is good for larger bulbs it is not suitable or cost-effective for small bulbs. It would be desirable to have a simpler and less expensive tool for removing small broken bulbs safely.

Accordingly, one object of the present invention is to provide an improved broken bulb remover for small bulbs.

Another object of the invention is to provide a broken bulb remover which guards against electrical hazards.

Another object of the invention is to provide a broken bulb remover which guards against physical hazards from broken glass when removing small bulbs.

Another object of the invention is to provide a broken bulb remover that is inexpensive and designed for mass production.

SUMMARY OF THE INVENTION

Briefly stated, the invention comprises a broken bulb remover especially adapted for removing a broken light bulb of the type having a threaded member attached to remaining portions of a broken glass envelope, a stem with a non-circular or paddle-shaped stem portion proximal the threaded member with a thickness and a width, and an extending stem portion distal the threaded member. The bulb remover comprises an elongated rod of non-conductive material having at least one end thereof having a surface tapered to conform to an interior wall of the glass envelope, a central cylindrical chamber having a lateral dimension less than the width of said paddle-shaped portion, the rod defining a lateral slot bifurcating said rod through a portion of the central chamber, said slot having a width greater than the thickness of said paddle-shaped portion, whereby the broken bulb may be removed by engaging and twisting the parts of said paddle-shaped portion disposed within the lateral slot while rotating and stabilizing the tool with said tapered surface. The central chamber extends beyond the lateral slot and is dimensioned so as to enclose the distal portion of the glass stem.

DRAWING

Figure 2:
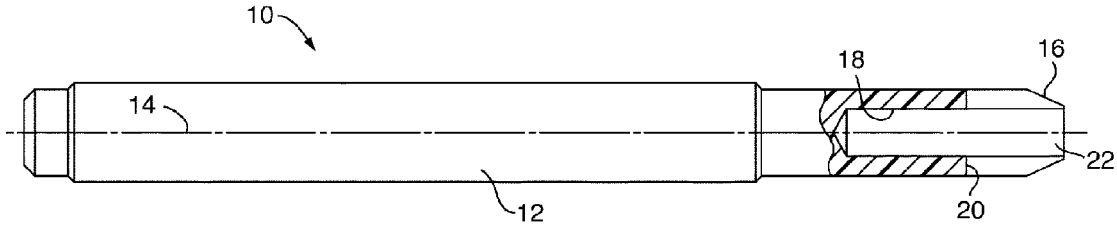
Figure 3:
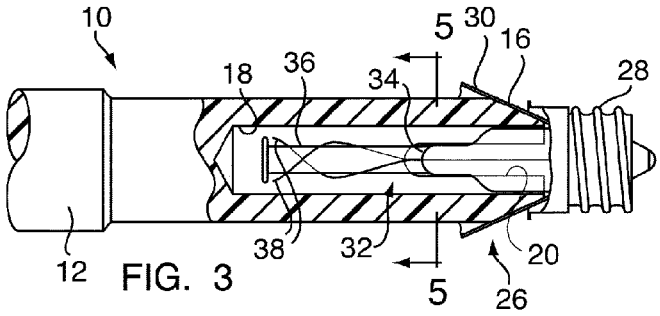
Figure 4:
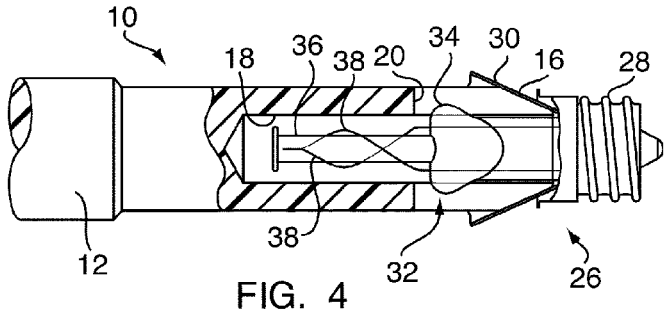
Figure 5:
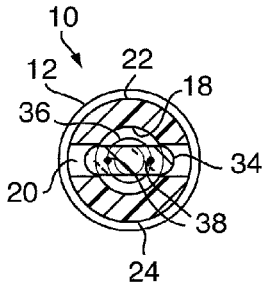
Figure 6:
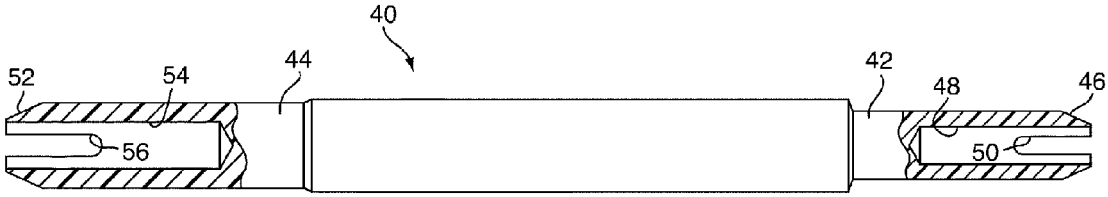

Other objects and advantages of the invention will be better understood by reference to the following description, taken in connection with the accompanying drawings in which:

FIG. 1 is a top plan view of the improved broken bulb remover, shown partly in cross-section, taken through its central axis, FIG. 2 is an elevation view of the broken bulb remover of FIG. 1 shown partly in cross-section, taken through its central axis, FIG. 3 is an enlarged view of a portion of FIG. 1 together with a broken bulb, FIG. 4 is an enlarged view of a portion of FIG. 2 together with a broken bulb, FIG. 5 is a cross-section view, taken along lines V—V of FIG. 3, looking in the direction of the arrows, and FIG. 6 is a plan view of a modified broken bulb remover, shown partly in section.

DETAILED DESCRIPTION

Referring now to FIGS. 1 and 2 of the drawing, plan and elevation views, respectively are shown of a broken bulb remover 10. The broken bulb remover 10 preferably comprises an elongated rod 12 that is symmetrical about a central axis 14. The rod 12 is shown as cylindrical, but could also have a polygonal cross-section, such as a hexagonal cross-section, and is made of non-conductive material. Rod 12 may be cast, extruded or injection molded of non-conductive plastic and may either be of transparent non-conductive plastic, such as Lucite® or may be of opaque non-conductive plastic, such as polyethylene, polystyrene, PVC, etc.

One end of rod 12 is tapered to provide a frusto-conical surface 16. The angle of taper is pre-selected to conform to the interior of the glass envelope surface of a small light bulb near the junction of the glass envelope and the metal threaded base of the bulb. The angle will vary according to the type of bulb to be removed, but I have found that a taper angle of about 25° measured from the axis 14 will be suitable for a large number of bulbs made by different manufacturers (an included angle of 50° for the frusto-conical surface). The length of the tapered portion is about 3/16 inches (48 mm.) on a 1/4 inch diameter cylindrical rod (63.5 mm.).

In order to enclose the dangerous glass stem and damaged filament-supporting wires of the broken bulb during removal. A central chamber 18 extends coaxially along rod 12 from the tapered end for a distance pre-selected to accommodate the stem and damaged filament of a selected type of bulb. Chamber 18 is preferably cylindrical but can also be polygonal in cross-section. A suitable dimension for chamber 18 is a cylindrical passage about one inch long (25.4 mm.) with a diameter of about 9/32 inches (7.1 mm.). The diameter of chamber 18 will vary with the type of bulb to be removed, but must be slightly larger than the greatest dimension of the stem on the bulb.

In order to provide a torquing surface for removal of the bulb, a lateral slot 20 is formed or cut so as to bifurcate the chamber 18, leaving two spaced shanks 22, 24. The length and width of the lateral slot 20 are pre-selected to accommodate the proximal stem portion of the broken bulb that is to be used to remove the bulb. Typically a proximal part of the stem adjacent to the metal thread encloses the filament-supporting wires and is larger in cross-section than the distal portion of the stem that supports filament wires external to the stem. This proximal portion is non-circular, often paddle-shaped having a lesser lateral dimension (or thickness) and a greater lateral dimension (or width).

The length of lateral slot 20 is selected to be longer than the paddle-shaped proximal stem portion when the tapered frusto-conical surface 16 contacts the interior surface of the broken glass envelope, and the width of the lateral slot is chosen to be greater than the lesser dimension (thickness) of the paddle-shaped portion of the stem. A suitable dimension for lateral slot 20 is a length of ½ inches (12.7 mm.) and a width of ⅛ inch (3.2 mm.).

Referring now to FIGS. 3, 4 and 5 of the drawing, enlarged views are shown, with portions of a broken bulb in place prior to removal. The same reference numbers for corresponding parts of the broken bulb remover 10 are used as in FIGS. 1 and 2.

A broken bulb indicated generally at 26 comprises a metal threaded member 28, and remnants of a glass envelope 30. A glass stem shown generally at 32 includes a paddle-shaped portion 34 proximal the threaded member 28 and a slender extension 36 distal to the threaded member. Filament supporting wires 38 are enclosed within the glass proximal portion 34 and are external to the distal portion 36.

Reference to FIG. 5 shows an end view cross-section with the paddle-shaped proximal portion 34 enclosed within the lateral slot 20. As seen there the central chamber 18 has a diameter less than the width of the proximal portion 34 and the lateral slot 20 has a width greater than the thickness of the proximal portion 34. Therefore, when the rod 10 is rotated about its axis, the abutting surfaces of the two spaced shanks 22, 24 will exert a torquing action on the proximal portion 34 to unscrew the threaded member from its socket.

The glass stem 32 and the wires 38 are extremely dangerous if an attempt is made to remove the bulb, since the wires have sharp ends and the stem may be partially damaged or may shatter when force is exerted on it. Since these members are enclosed within the central chamber 18, and since the rod is non-conductive, the broken bulb may be safely removed and discarded.

Modification

FIG. 6 illustrates a modified form of the invention used for two different sizes or types of small bulbs. A double-ended broken bulb remover is shown generally at 40. Opposite rod portions 42, 44 are shown that may be of different diameters to accommodate two different sizes of small bulbs. The right hand side 42 has a tapered surface 46, a central chamber 48 and a lateral slot 50 bifurcating the central chamber. The left-hand side 44 has a tapered surface 52, a central chamber 54 and a lateral slot 56 bifurcating the central chamber. The dimensions for the central chambers, lateral slots and taper angles may be chosen to fit two different size or type bulbs using the criteria set forth above.

While there has been described what is considered to be the preferred embodiment of the invention and one modification, it is desired to secure in the appended claims all such modifications as fall within the true spirit and scope of the invention.

What is claimed is:

1. Broken bulb remover especially adapted for removing a broken light bulb of the type having a threaded member attached to remaining wall portions of a broken glass envelope, a glass stem with a first non-circular stem portion proximal the threaded member having a thickness and a width, and a second slender stem portion distal the threaded member, said broken bulb remover comprising an elongated rod of non-conductive material having an axis and defining a tapered surface on at least one end thereof arranged to conform to said remaining wall portions, said elongated rod defining a central longitudinal chamber open at said one end of the rod and having a lateral dimension less than the width of said first stem portion, said rod further defining a lateral slot bifurcating said rod through a portion of the central chamber, said slot having a width greater than the thickness of said first stem portion, whereby the broken bulb may be removed by engaging and twisting the parts of said first stem portion disposed within the lateral slot while rotating and stabilizing the tool with said tapered surface.

2. The broken bulb remover according to claim 1, wherein said central chamber extends within said rod beyond said lateral slot and is dimensioned so as to enclose the second stem portion of said glass stem when the first stem portion is within said lateral slot.

3. The broken bulb remover according to claim 1, wherein said tapered surface is frustoconical.

4. The broken bulb remover according to claim 1, wherein said central longitudinal chamber is substantially cylindrical and has a length sufficient to receive said first and second stem portions when said tapered surface contacts said remaining wall portions of the glass envelope and a diameter sufficient to receive said second stem portion.

5. The broken bulb remover according to claim 1, wherein said lateral slot is dimensioned so as to enclose a first stem portion that is substantially paddle-shaped.

6. The broken bulb remover according to claim 1, wherein said broken bulb remover is a PVC injection molded part.

7. The broken bulb remover according to claim 1, wherein the other end of said rod defines a second tapered surface on the other end thereof arranged to conform to said remaining wall portions, and wherein said elongated rod defines a second central longitudinal chamber open at said other end of the rod and having a lateral dimension less than the width of said first stem portion, said rod further defining a second lateral slot bifurcating said rod through a portion of the second central chamber, said slot having a width greater than the thickness of said first stem portion.

8. Broken bulb remover especially adapted for removing a broken light bulb of the type having a threaded member attached to remaining wall portions of a broken glass envelope, a glass stem with a paddle-shaped stem portion proximal the threaded member having a thickness and a width, and a slender stem portion distal the threaded member, said broken bulb remover comprising an elongated rod of non-conductive material having an axis and defining a frusto-conical surface on at least one end thereof arranged to conform to said remaining wall portions, said elongated rod defining a central longitudinal chamber open at said one end of the rod and having a lateral dimension less than the width of said paddle-shaped stem portion, said rod further defining a lateral slot bifurcating said rod through a portion of the central chamber, said slot having a width greater than the thickness of said paddle-shaped stem portion, said central chamber extending within said rod beyond said lateral slot and dimensioned so as to enclose the slender distal stem portion of said glass stem when the paddle-shaped stem portion is within said lateral slot, whereby the broken bulb may be removed by engaging and twisting the parts of said paddle-shaped stem portion disposed within the lateral slot while rotating and stabilizing the tool with said tapered surface, while the slender stem portion is contained within the central chamber.

* * * * *